United States Patent [19]

Ess

[11] 4,317,397

[45] Mar. 2, 1982

[54] SYSTEM FOR THE STAGGERED DIVISION OF PLANAR WORKPIECES

[75] Inventor: Wilfried Ess, Schwarzach, Austria

[73] Assignee: Schelling & Co., Schwarzach, Austria

[21] Appl. No.: 153,864

[22] Filed: May 28, 1980

[30] Foreign Application Priority Data

Jun. 11, 1979 [AT] Austria ..... 4147/79

[51] Int. Cl.[3] ..... B26D 5/20

[52] U.S. Cl. ..... 83/35; 83/39; 83/256; 83/404.1; 83/404.2

[58] Field of Search ..... 83/35, 39, 44, 47, 255, 83/256, 404, 404.1, 404.2, 404.4

[56] References Cited

U.S. PATENT DOCUMENTS 1,237,435 8/1917 Winkley ..... 83/404.1

3,826,164 7/1974 Campbell ..... 83/256

FOREIGN PATENT DOCUMENTS 1428268 3/1976 United Kingdom ..... 83/47

*Primary Examiner*—James M. Meister

*Assistant Examiner*—K. Bradford Adolphson

*Attorney, Agent, or Firm*—Toren, McGeady & Stanger

[57] ABSTRACT

A system for cutting generally planar quadrilateral workpieces into a plurality of quadrilateral elements, at least a portion of which have both their length and width dimensions smaller than the overall length and width dimensions of the original workpiece wherein cuts extending completely across the workpiece parallel to one of the length and the width dimensions thereof are first effected by a first saw with the cut pieces being then conveyed to a third saw where cuts completely thereacross may be made in directions perpendicular to the one dimension. The remainder of the workpiece is conveyed to a second saw where cuts are made in directions parallel to the other of the length and width dimensions with the cut portions of the workpiece remainder being subsequently conveyed to the third saw for effecting cuts in the cut portions in directions parallel to the one dimension. The pieces initially cut from the workpiece by the first saw bypass the second saw and instead of being conveyed directly to the third saw they may be conveyed to a storage table for temporary storage after which they may be conveyed to the third saw. The system includes a transfer table which may operate to rotate the bypassed pieces through 90° and to feed the bypassed pieces either directly to the third saw or to the storage table for subsequent feeding from the storage table to the third saw.

8 Claims, 2 Drawing Figures

19
B
A
16

22
4
18
7
6
5'
5
3
4'
1
8'
10
8
9
11
12
13
15
21
23
14
2
20
22

SYSTEM FOR THE STAGGERED DIVISION OF PLANAR WORKPIECES

The present invention relates generally to a system for cutting a planar workpiece such as a panel or the like and more particularly to a system for the staggered division of such a workpiece wherein the workpiece is movable upon a conveyer table and may be held stationery during the cutting procedures. The system includes at least a longitudinal cutting saw and a first crosscutting saw, both structured as saws operating below the conveying table and provided for successively dividing workpieces in longitudinal cuts and in crosscuts which extend perpendicularly to each other. Downstream of the longitudinal cutting saw, taken in the direction of workpiece flow through the system, a second movable circular saw is arranged for performing crosscuts. Stops and conveying units are provided in order to correctly position and feed the workpieces.

In systems for staggered division of workpieces of the type to which the present invention relates, the aim is usually to divide the workpieces in such a way that it is possible to effect continuous longitudinal cuts so that, subsequently, by advancing the strips obtained in this manner through greater or lesser distances, continuous cutting lines are created which may then be cut in a crosscutting saw.

However, in order to obtain the best possible utilization of the workpieces, a workpiece must be divided in such a manner that continuous longitudinal cuts over the entire length of the workpiece are not possible. Therefore, it may be initially necessary to perform one or more cross cuts and it may only be possible to subsequently divide the remaining length of the workpiece by means of the longitudinal cuts and by subsequent crosscuts.

In workpieces which are divided in this manner, the portion which must be initially processed by crosscutting may be referred to as a headpiece or header, with the remaining portion of the length of the workpiece being called the main piece or the remainder. When dividing the workpiece in this manner, difficulties arise with respect to treatment or processing and it has been found that no satisfactory solution has as yet been devised to overcome these difficulties.

In a known system for the staggered division of workpieces, the workpiece is originally shortened by the headpiece and in this case, a movable shortening saw arranged above the table and on one side of the machine in the region situated ahead of the longitudinal cutting saw is utilized. The cutting plane of this above-table shortening saw is arranged perpendicularly to the cutting plane of the longitudinal cutting saw. In such a system, on the side facing away from the shortening saw there is arranged a feed unit which feeds the planar workpieces either individually or in stacks to the shortening saw. It has been found that, on the one hand, the above-table saws do not allow an exact processing of the workpieces to be performed. Furthermore, it is considered significant that a disadvantage of such a system resides in the fact that the headpieces cut in this manner must be again subsequently fed to the longitudinal cutting saw and then to the crosscut saw where they are finally divided. The passage of small headpieces through the longitudinal cutting saw makes the system more expensive or complicated because only large pieces are usually processed in the longitudinal cutting saw. Therefore, in longitudinal cutting saws, the table must be provided with a significantly smaller number of support rollers than would be the case, for example, in the region of the crosscut saws. However, when the workpiece is already divided into small pieces in the longitudinal cutting saw, an appropriate support structure must also be provided in this region.

Additionally, this manner of operation results in substantial delays in the processing of the workpieces because the longitudinal cutting saw must only perform longitudinal cuts over a small portion of the length as compared to the possible entire width of operation and because headpieces and mainpieces or remainders must be successfully processed by the longitudinal cutting saw as well as by the crosscut saw.

Therefore, it is an object of the present invention to provide a system enabling exact cutting of workpieces to be processed and further enabling the final cuts to always be performed on a crosscut saw which operates after the longitudinal cutting saw has operated.

SUMMARY OF THE INVENTION

In accordance with the present invention, the particular advantages thereof are achieved in that a table for feeding workpieces is arranged to extend parallel to the cutting plane of the longitudinal cutting saw with an additional head or end-cut saw, constructed as a below-the-table circular saw, being assigned to this table. Outside of the range of operation of the longitudinal cutting saw, and between the table located in front of the longitudinal cutting saw and the table located in front of the crosscut saw, a transfer table and/or appropriate conveying units which may possibly be equipped with a turning device, are provided for feeding the pieces cut by the end-cut saw either directly or indirectly through a storage table to the crosscut saw while bypassing the longitudinal cutting saw.

As a result of the measures undertaken in accordance with the invention, a headpiece of the workpiece may be cut to the exact size in the cross direction. The cut, strip-like headpieces are then fed to the crosscut saw either directly or, advantageously, through a storage table. The remaining main or remainder part of the workpiece is then initially cut in the usual manner by the longitudinal cutting saw and it is then conveyed to the crosscut saw for further cutting.

Additional advantages are especially obtained when the headpieces are temporarily stored during the cutting process. In this case, several main pieces may be initially cut in accordance with a particular program, without requiring readjustment, and subsequently several headpieces may be cut. Thereafter, the headpieces may be cut in a staggered manner by means of the existing crosscut saw and its conveyer carriages. By combining the headpiece strips into groups, the full cutting length of the crosscut saw may be utilized. On the other hand, when these headpieces are passed through the longitudinal cutting saw, only a small portion of its length will be utilized. In accordance with the present invention it is possible to significantly minimize reduction in the output of the system which may otherwise be unavoidable in the cutting patterns of the workpieces in which headpieces are cut. Since, initially, only main pieces are cut for a certain time, these pieces may be stacked as usual. The stacks are then removed when the program is changed. Subsequently, for a certain time, headpieces are cut, stacked and removed. In the sorting and stacking units, the change from main piece to headpiece may be treated as though a change in the cutting pattern had taken place. The cut-to-size headpieces have the same accuracy and quality of cut as the cut-to-size main pieces because all the cuts may be performed by means of the below-table circular saws.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF PREFERRED EMBODIMENTS

Figures 1, 2:
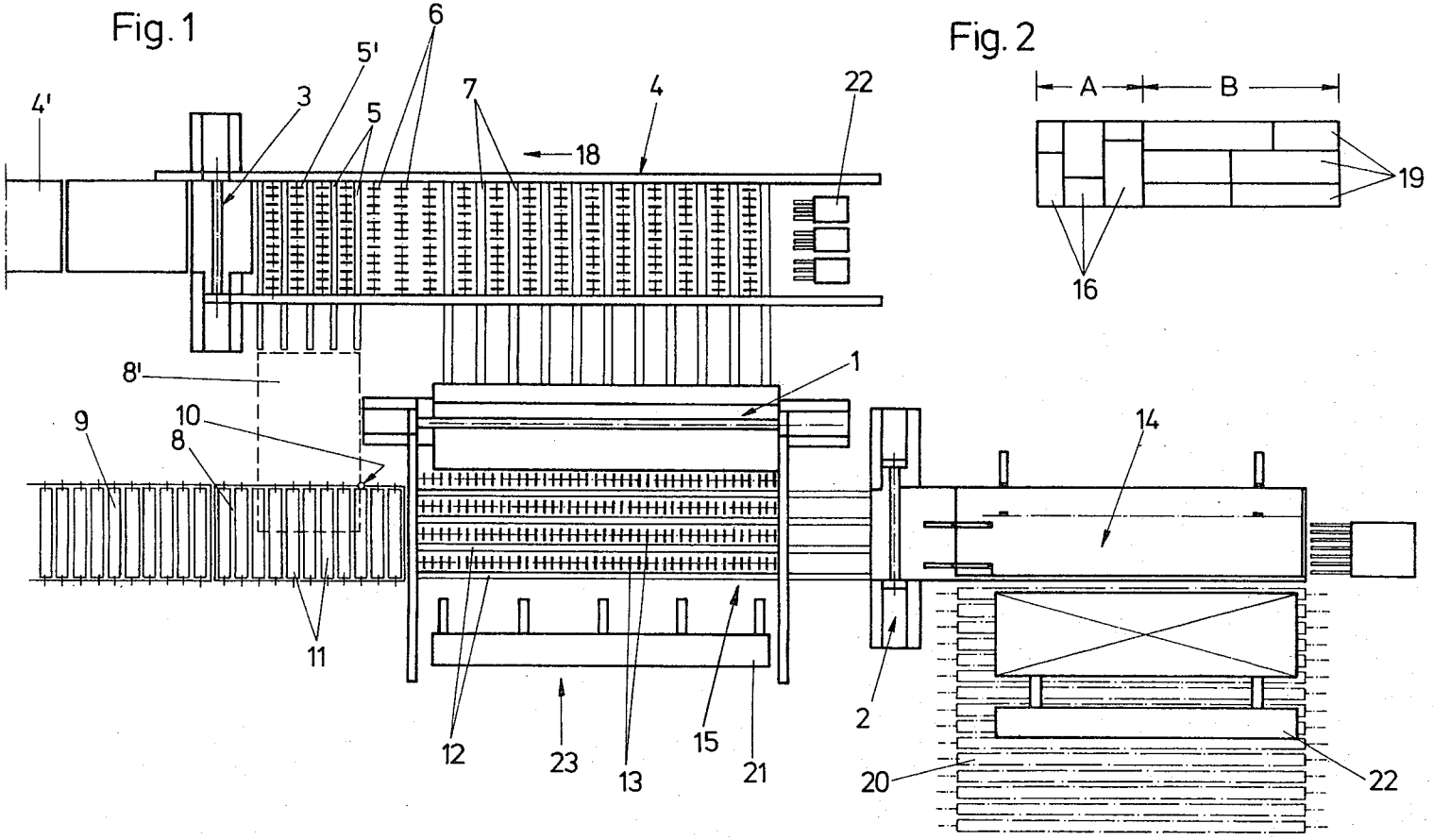
FIG. 1 is a schematic top view of a system for staggered cutting of workpieces in accordance with the present invention.
FIG. 2 is a schematic diagram showing the cutting pattern of a workpiece which may be cut by the system of the present invention.

Referring now to the drawing, there is illustrated a system in accordance with the present invention for performing staggered division of workpieces which consist essentially of a planar configuration. The system consists, on the one hand, of a conventional system with a longitudinal cutting saw 1 and a crosscut saw 3 and of appropriate stops and conveying units which operate to effect correct positioning and feed of the workpieces. For the sake of clarity, the conveying units and the stops are not illustrated in totality. The longitudinal cutting saw 1 and the crosscut saw 3 are arranged at right angles to each other.

In the operation of the system, workpieces are fed to the appropriate saws on tables which may comprise conveyor table means and which may be formed from rotatably supported rollers, balls, cylinders conveyer belts or the like.

A table 14 for supplying workpieces is aligned parallel to the cutting plane of the longitudinal cutting saw 1 wherein an additional end cut or crosscut saw 2 constructed as a below-the-table circular saw is arranged in this table 14.

A table 15 which is provided with conveying units 12 in the form of conveyer belts and having rollers 13 is located forwardly of the table 14 and serves to feed workpieces into the region adjacent or in front of the longitudinal cutting saw 1. The conveying units 12 are arranged so that they may be raised and lowered. Accordingly, feed of the workpieces in a direction parallel to the longitudinal cutting saw is possible and, furthermore, subsequent feed on rollers 13 transversely of the longitudinal cutting saw direction is also facilitated. A sliding carriage 21 is provided for laterally urging the workpieces into proper alignment for cutting with the longitudinal cutting saw 1. The longitudinal cutting saw 1 is followed by conveying units 7 which, together with rollers 6, form a table 4. The conveying units 7 are again constructed in the form of conveyer belts which are arranged so that they may be raised and lowered. For receiving and conveying pieces which have been cut in the longitudinal direction, the conveying units 7 are raised so that feeding to the table 4 may be effected. After feeding, these conveying units 7 are again lowered so that the workpieces may be moved on the roller 6 by means of the feed units 22 in the direction of the arrow 18 whereby they may be fed to a crosscut saw 3.

The crosscut saw 3 is followed by a device for conveying the cut pieces. However, this device is not illustrated in detail in FIG. 1.

Furthermore, a transfer table 8 is provided for feeding the pieces cut by the end cut saw 2 directly or indirectly to the crosscut saw 3 while bypassing the longitudinal cutting saw 1. Immediately forwardly of the crosscut saw 3, conveying units are provided which are constructed, for example, as narrow conveyor belts. These conveying units 5 are aligned transversely to the longitudinal extension of the table 4 and they may be raised and lowered relative to the table 4. The conveying units 5 serve to receive cut pieces, previously referred to as headpieces, from the transfer table 8 which, at that time, is arranged in a position 8', as illustrated in broken lines. In order to effect the transfer of the cut pieces known as headpieces, the transfer table 8 may be aligned with the conveying units 12 of the table 15 extending parallel to the cutting plane of the longitudinal cutting saw 1 and with the table 8 extending perpendicularly to the cutting plane of the crosscut saw 3. Advantageously, this is effected by arranging the table 15 and the conveying units 5 at the same vertical level and also by arranging the transfer table 8 in such a manner that it may be rotated in a horizontal plane about a vertical axis 10.

The width of the conveying units 12 and of the conveying units 5 and the width of the transfer table 8 may be equal to or greater than the initial width of the workpiece so that it will be possible to receive all of the headpieces adjacent each other.

A significant saving in time may be accomplished and better adjustability of control units may be obtained when the apparatus is provided with facilities for temporary storage of cut headpieces. In the embodiment of the present invention illustrated, when the transfer table 8 is in a position aligned with the table 15 of the longitudinal cutting saw 1, a storage table 9 is arranged adjacent the transfer table 8 at the discharge end thereof. The transfer table 8 and the storage table 9 are equipped with a plurality of rollers 11 having parallel axes, these rollers being preferably driven rollers.

The work sequence of the system illustrated for effecting staggered division of workpieces involves an initial feeding of the workpieces over the roller conveyor 20 to the end-cut saw 2 by means of the feed carriage 22. Appropriate crosscuts are effected and strips 16 which constitute the headpiece A, illustrated in FIG. 2, are cut by the saw 2. It will be noted that in the formation of each of the strips 16, a cut is made which extends completely across the width of the workpiece illustrated in FIG. 2. The strips 16 thus formed are advanced until all of the strips are moved by the succeeding main piece B to the transfer table 8. These cut headpieces are then fed to the storage table 9 by means of the driven rollers 11 of the transfer table 8.

Subsequently, the conveying units 12 are lowered and by lowering of these conveying units 12 the remaining main piece is fed to the longitudinal cutting saw 1 in the direction of arrow 23 whereupon longitudinal cuts are performed on the main piece. The cut strips 19 of the main piece are then transferred to the conveying unit 7 of the table 4. Accordingly, the driven conveyer belts feed the strips to the table 4. After such feeding has been completed, these conveying units are again lowered whereupon the individual strips are fed to the crosscut saw 3 by means of the feed units 22 where the main pieces are finally divided. The cut pieces then reach a table 4' and they are subsequently conveyed to a stacking device (not shown).

Although it is considered conceivable that crosscutting of the main piece be followed immediately by crosscutting of the headpiece it would require, however, for this purpose that the programs for the system be changed repeatedly. Therefore, it is a special feature of the present invention that the cut headpieces must be stored so that, only after a successive division of a large number of main pieces, the stored headpieces are divided. In other words, when the desired number of workpiece stacks is divided, the program may be changed from "divide main pieces" to "divide headpieces". The headpieces (headpiece strips) are returned from the storage table to the transfer table 8 in groups in accordance with the cutting length of the crosscut saw 3 whereupon the transfer table 8 is rotated about the vertical axis 10. As a result, the transfer table 8 will be in position 8' illustrated in broken line in the drawing. By means of appropriate conveying units 5, which in this position may be raised above the plane of the table 4, these headpieces which had been turned by 90° as a result of rotation of the transfer table 8 are fed to the table 4. As soon as these pieces have reached the correct position with regard to the crosscut saw 3, the conveying units 5 are again lowered so that these head piece strips may be fed over the rollers 5' to the crosscut saw 3 by means of the feed units 22.

In accordance with the description set forth above, the transfer table 8 may be aligned with the conveying units 12 extending parallel to the cutting plane of the longitudinal cutting saw 1 and with the conveying units 5 extending parallel to the cutting plane of the crosscut saw 3. Of course, various modifications are possible within the scope of the invention. For example, it is not absolutely required to provide a transfer table 8 because it would also be possible to provide other transfer means. For example, the cut head pieces could also be fed to a storage table 9 by means of a suction-type of lifting device. Of course, any type of storage table is also conceivable since it is only necessary to store the cut head pieces in some manner and to feed them later to the table 4 of the crosscut saw 3. Additionally, the arrangement of the conveying units which are raised and lowered and the rollers which form the tables may be variable. It is only essential and important that the head pieces of a workpiece to be divided are cut within an exact cut by means of a circular saw which is of the below-the-table type whereupon these headpiece strips are fed to a storage area while bypassing the longitudinal cutting saw 1. Accordingly, the main piece may be divided in a conventional manner and, thereafter the head piece strips or a plurality of strips of different head pieces may be fed directly to the crosscut saw. Significant increase in the output of the system may be achieved, especially by providing the facility for storage of the head pieces, because it is not necessary to constantly change the program for cutting of the successive main and head pieces.

While a specific embodiment of the invention has been shown and described in detail to illustrate the application of the inventive principles, it will be understood that the invention may be embodied otherwise without departing from such principles.

What is claimed is:

1. A system for effecting staggered division of planar workpieces comprising: conveyer table means upon which said workpieces are movable and held stationery during a cutting procedure; a first crosscut saw and a longitudinal cutting saw constructed to effect cutting from below said table means and arranged to successively divide said workpieces along crosscuts and longitudinal cuts which extend perpendicularly to each other; a second cross-cut saw provided forwardly of said longitudinal cutting saw; stop and conveying means for effecting feeding and correct positioning of workpieces through said system; a first conveyer table feeding workpieces in directions parallel to the cutting directions of said longitudinal saw for feeding workpieces to said first crosscut saw and to said longitudinal cutting saw; a second conveyer table feeding workpieces to said second crosscutting saw; a transfer table arranged between said first and said second conveyer table; and a storage table provided forwardly of said transfer table; said transfer table being arranged to bypass said longitudinal cutting saw and to selectively feed pieces cut by said first crosscut saw from said first conveyer table to either said storage table or to said second conveyer table, and from said storage table to said second conveyer table.

2. A system according to claim 1 wherein said transfer table comprises a turning device for rotating workpieces thereon through an angle 90°.

3. A system according to claim 1 wherein said transfer table immediately follows said first conveyer table and wherein conveying units assigned to said transfer table are arranged to be aligned with conveying units extending parallel to the cutting plane of said longitudinal cutting saw and, after appropriate shifting thereof, to be aligned with conveying units extending parallel to the cutting plane of said second crosscut saw.

4. A system according to claim 1 wherein conveying units are provided rearwardly of said second crosscut saw for receiving cut pieces from said transfer table, said conveying units being adapted to be raised and lowered relative to said second conveyor table and adapted to be aligned transversely of the longitudinal extension of said second conveyer table which operates to receive and feed pieces discharged from said longitudinal cutting saw.

5. A system according to claim 1 wherein said transfer table is arranged to be rotated about a vertical axis.

6. A system according to claim 1 wherein said transfer table is arranged to be aligned with said first conveyer table and wherein when said transfer table is in a position aligned with said first conveyer table said storage table is arranged adjacent said transfer table at an end thereof opposite an end adjacent to said first conveyer table.

7. Apparatus for cutting a generally planar quadrilateral workpiece into a plurality of quadrilateral elements, with at least a portion of said quadrilateral elements having both the length and the width dimension thereof smaller than the length and width dimension of said workpiece comprising:

a first, a second and a third saw, said first and said third saws being arranged to effect cutting in parallel directions, said second saw being arranged to effect cutting in directions perpendicular to the cutting directions of said first and said third saws;

table conveyer means for conveying workpieces to be cut and cut pieces of said workpieces to each of said first, said second and said third saws in a generally horizontal position;

said saws being arranged to be movable to effect cutting operations from beneath said table conveyer means;

said table conveyer means comprising means for conveying a workpiece to said first saw and for indexing said workpiece relative to said first saw to align said first saw with positions on said workpiece where cuts completely across said workpiece are required in directions parallel to one of said length and width dimensions thereof, means bypassing said second saw for conveying portions cut from said workpiece by said first saw to said third saw while rotating said cut portions through 90° before reaching said third saw and for indexing said cut portions relative to said third saw to align said third saw with positions on said cut portions where cuts completely across said cut portions are required in directions parallel to the other of said length and width dimensions, means for conveying the remainder of said workpiece to said second saw and for indexing said workpiece remainder to align said second saw with positions on said workpiece remainder where cuts completely thereacross are required in directions perpendicular to said one dimension, and means for conveying the pieces of said cut workpiece remainder to said third saw and for indexing said cut pieces to align said third saw with positions on said cut pieces where cuts completely thereacross are required in directions parallel to said one dimension.

8. A method for cutting a generally planar quadrilateral workpiece into smaller quadrilateral elements, with at least a portion of said quadrilateral elements having both the length and the width dimension thereof smaller than the length and width dimensions of said workpiece comprising the steps of:

conveying said workpiece in a generally horizontal position on conveyer table means to a first saw arranged to effect cutting of said workpiece from beneath said conveyer table means in directions parallel to one of said length and width dimensions thereof;

indexing said workpiece relative to said first saw to align said first saw with positions on said workpiece where cuts completely thereacross in directions parallel to said one dimension are required to produce said smaller elements;

operating said first saw to produce said cuts completely across said workpiece at each of said aligned positions;

conveying the portions thus cut from said workpiece on said conveyer table means to a temporary storage location;

conveying the remainder of said workpiece to a second saw arranged to effect cutting in directions perpendicular to the cutting direction of said first saw from beneath said conveyer table means;

indexing said workpiece remainder relative to said second saw to align said second saw with positions on said workpiece remainder where cuts completely across said workpiece remainder in directions parallel to the other of said length and width dimensions are required to produce said smaller elements;

operating said second saw to produce said cuts completely across said workpiece remainder at each of said aligned positions;

conveying the pieces of said cut workpiece remainder to a third saw arranged to effect cutting in directions perpendicular to the cutting direction of said second saw from beneath said conveyer table means;

indexing the pieces of said cut workpiece remainder relative to said third saw to align said third saw with positions on said pieces where cuts completely across said pieces in directions parallel to said one dimension are required to produce said smaller elements;

operating said third saw to produce said cuts completely across said pieces at each of said aligned positions;

rotating the portions first cut from said workpiece by said first saw through 90°;

conveying said rotated portions on said table conveyer means to said third saw;

indexing said rotated portions relative to said third saw to align said third saw with positions on said rotated portions where cuts completely across said rotated portions in directions perpendicular to said one dimension are required to produce said small elements; and operating said third saw to produce said cuts completely across said rotated portions at each of said aligned positions.

* * * * *